US006401977B1

(12) United States Patent
Ross, III

(10) Patent No.: US 6,401,977 B1
(45) Date of Patent: Jun. 11, 2002

(54) TOOTHPASTE EXTRACTING DEVICE

(76) Inventor: Garrison A. Ross, III, 6464 19th St. West #B, Tacoma, WA (US) 98466

( * ) Notice: Subject to any disclaimer, the term of this patent is extended or adjusted under 35 U.S.C. 154(b) by 0 days.

(21) Appl. No.: 09/895,044

(22) Filed: Jun. 29, 2001

(51) Int. Cl.[7] ..... B65D 35/28

(52) U.S. Cl. ..... 222/99; 222/92; 222/95; 222/100; 222/333

(58) Field of Search ..... 222/99, 100, 101, 222/102, 92, 95, 333

(56) References Cited

U.S. PATENT DOCUMENTS

| | | | | | |
|---|---|---|---|---|---|
| 1,299,758 | A | * | 4/1919 | Mullaly | |
| 1,514,018 | A | * | 11/1924 | Sharpe | |
| 1,590,626 | A | * | 6/1926 | Highley | |
| 2,004,015 | A | * | 6/1935 | Scott | 221/60 |
| 2,545,342 | A | * | 3/1951 | Choquette | 222/101 |
| 2,570,755 | A | * | 10/1951 | Booth | 222/96 |
| 2,586,922 | A | * | 2/1952 | De Moss | 222/100 |
| 2,742,189 | A | * | 4/1956 | Morrison | 222/100 |
| 2,837,243 | A | * | 6/1958 | La Zebnik | 222/101 |
| 3,204,824 | A | * | 9/1965 | McGraw, Jr. | 222/100 |
| 3,860,147 | A | * | 1/1975 | Vessio et al. | 222/96 |
| 4,132,330 | A | * | 1/1979 | Rauscher et al. | 222/76 |
| 4,234,104 | A | * | 11/1980 | Apuzzo, Jr. et al. | 222/94 |
| 4,258,864 | A | | 3/1981 | Karamanolis et al. | |
| 4,403,714 | A | | 9/1983 | Kane | |
| 4,418,840 | A | * | 12/1983 | Gardner, Sr. | 222/96 |
| 4,508,242 | A | * | 4/1985 | Wolfe | 222/102 |
| 4,600,126 | A | * | 7/1986 | Arango | 222/82 |
| 5,199,610 | A | | 4/1993 | Gagliardi | |
| 5,203,473 | A | * | 4/1993 | Willey | 222/94 |
| 5,215,218 | A | | 6/1993 | Choi | |
| 5,248,061 | A | * | 9/1993 | Weiselfish et al. | 222/63 |
| D398,467 | S | | 9/1998 | Kunik | |
| 5,845,813 | A | * | 12/1998 | Werner | 222/101 |
| 5,875,929 | A | | 3/1999 | Nguyen | |
| 5,975,362 | A | | 11/1999 | West | |

* cited by examiner

*Primary Examiner*—Henry C. Yuen
*Assistant Examiner*—Frederick Nicolas

(57) ABSTRACT

A toothpaste extracting device includes a housing having a front wall, a back wall, a top wall, a bottom wall, a first side wall and a second side wall. The front wall has an opening therein. The opening is generally bounded by an inner housing having an upper wall having an aperture extending therethrough for receiving an open end of a tube of toothpaste. Each of first and second side walls has an elongated slot therein. A spindle is positioned in the housing and extends through each of the slots. The spindle has an engaging portion adapted for removably receiving a closed end of the toothpaste tube. A pair of gears is positioned on the spindle. A pair of tracks is positioned on an inner surface of the front wall and engage each of the gears. A motor rotates the spindle when turned on by an actuator.

8 Claims, 5 Drawing Sheets

TOOTHPASTE EXTRACTING DEVICE

BACKGROUND OF THE INVENTION

1. Field of the Invention

The present invention relates to toothpaste dispensing devices and more particularly pertains to a new toothpaste extracting device for dispensing toothpaste from a tube of toothpaste and for indicating when the tube is empty.

2. Description of the Prior Art

The use of toothpaste dispensing devices is known in the prior art. More specifically, toothpaste dispensing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,199,610; 4,403,714; 4,258,864; 5,215,518; 5,975,362; 5,875,929; and U.S. Des. Pat. No. 398,467.

While these devices fulfill their respective, particular objectives and requirements, the aforementioned patents do not disclose a new toothpaste extracting device. The inventive device includes a housing having a front wall, a back wall, a top wall, a bottom wall, a first side wall and a second side wall. The back wall is removably attached to the housing and defines a door. The front wall has an opening therein positioned generally adjacent to a juncture of the bottom wall and the first side wall. Each of first and second side walls has an elongated slot therein. The opening is generally bounded by an inner housing having an upper wall having an aperture extending therethrough for receiving an open end of the tube of toothpaste. A spindle is positioned in the housing and extends through each of the slots. The spindle has an engaging portion positioned adjacent to the first side wall adapted for removably receiving a closed end of the toothpaste tube. A pair of gears is positioned on the spindle. A pair of tracks is positioned on an inner surface of the front wall. The tracks are spaced from each other. Each of the gears is positioned to engage one of the tracks. A motor for rotating the spindle is mechanically coupled to the spindle. An actuator for turning the motor on such that the motor rotates the spindle in a first direction toward the bottom wall is operationally coupled to the motor.

In these respects, the toothpaste extracting device according to the present invention substantially departs from the conventional concepts and designs of the prior art, and in so doing provides an apparatus primarily developed for the purpose of dispensing toothpaste from a tube of toothpaste and for indicating when the tube is empty.

SUMMARY OF THE INVENTION

In view of the foregoing disadvantages inherent in the known types of toothpaste dispensing devices now present in the prior art, the present invention provides a new toothpaste extracting device construction wherein the same can be utilized for dispensing toothpaste from a tube of toothpaste and for indicating when the tube is empty.

The general purpose of the present invention, which will be described subsequently in greater detail, is to provide a new toothpaste extracting device apparatus and method which has many of the advantages of the toothpaste dispensing devices mentioned heretofore and many novel features that result in a new toothpaste extracting device which is not anticipated, rendered obvious, suggested, or even implied by any of the prior art toothpaste dispensing devices, either alone or in any combination thereof.

To attain this, the present invention generally comprises a housing having a front wall, a back wall, a top wall, a bottom wall, a first side wall and a second side wall. The back wall is removably attached to the housing and defines a door. The front wall has an opening therein positioned generally adjacent to a juncture of the bottom wall and the first side wall. Each of first and second side walls has an elongated slot therein. The opening is generally bounded by an inner housing having an upper wall having an aperture extending therethrough for receiving an open end of the tube of toothpaste. A spindle is positioned in the housing and extends through each of the slots. The spindle has an engaging portion positioned adjacent to the first side wall adapted for removably receiving a closed end of the toothpaste tube. A pair of gears is positioned on the spindle. A pair of tracks is positioned on an inner surface of the front wall. The tracks are spaced from each other. Each of the gears is positioned to engage one of the tracks. A motor for rotating the spindle is mechanically coupled to the spindle. An actuator for turning the motor on such that the motor rotates the spindle in a first direction toward the bottom wall is operationally coupled to the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toothpaste extracting device apparatus and method which has many of the advantages of the toothpaste dispensing devices mentioned heretofore and many novel features that result in a new toothpaste extracting device which is not anticipated, rendered obvious, suggested, or even implied by any of the prior art toothpaste dispensing devices, either alone or in any combination thereof.

It is another object of the present invention to provide a new toothpaste extracting device which may be easily and efficiently manufactured and marketed It is a further object of the present invention to provide a new toothpaste extracting device which is of a durable and reliable construction.

An even further object of the present invention is to provide a new toothpaste extracting device which is susceptible of a low cost of manufacture with regard to both materials and labor, and which accordingly is then susceptible of low prices of sale to the consuming public, thereby making such toothpaste extracting device economically available to the buying public.

Still yet another object of the present invention is to provide a new toothpaste extracting device which provides in the apparatuses and methods of the prior art some of the advantages thereof, while simultaneously overcoming some of the disadvantages normally associated therewith.

Still another object of the present invention is to provide a new toothpaste extracting device for dispensing toothpaste from a tube of toothpaste and for indicating when the tube is empty.

Yet another object of the present invention is to provide a new toothpaste extracting device which includes a housing having a front wall, a back wall, a top wall, a bottom wall, a first side wall and a second side wall. The back wall is removably attached to the housing and defines a door. The front wall has an opening therein positioned generally adjacent to a juncture of the bottom wall and the first side wall. Each of first and second side walls has an elongated slot therein. The opening is generally bounded by an inner housing having an upper wall having an aperture extending therethrough for receiving an open end of the tube of toothpaste. A spindle is positioned in the housing and extends through each of the slots. The spindle has an engaging portion positioned adjacent to the first side wall adapted for removably receiving a closed end of the toothpaste tube. A pair of gears is positioned on the spindle. A pair of tracks is positioned on an inner surface of the front wall. The tracks are spaced from each other. Each of the gears is positioned to engage one of the tracks. A motor for rotating the spindle is mechanically coupled to the spindle. An actuator for turning the motor on such that the motor rotates the spindle in a first direction toward the bottom wall is operationally coupled to the motor.

Still yet another object of the present invention is to provide a new toothpaste extracting device that has an actuator located where the toothpaste is dispensed for easy dispensing and application of the toothpaste onto the toothbrush.

Even still another object of the present invention is to provide a new toothpaste extracting device that has a housing have a slot therein for allowing the user to see when the tube of toothpaste is nearly empty.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
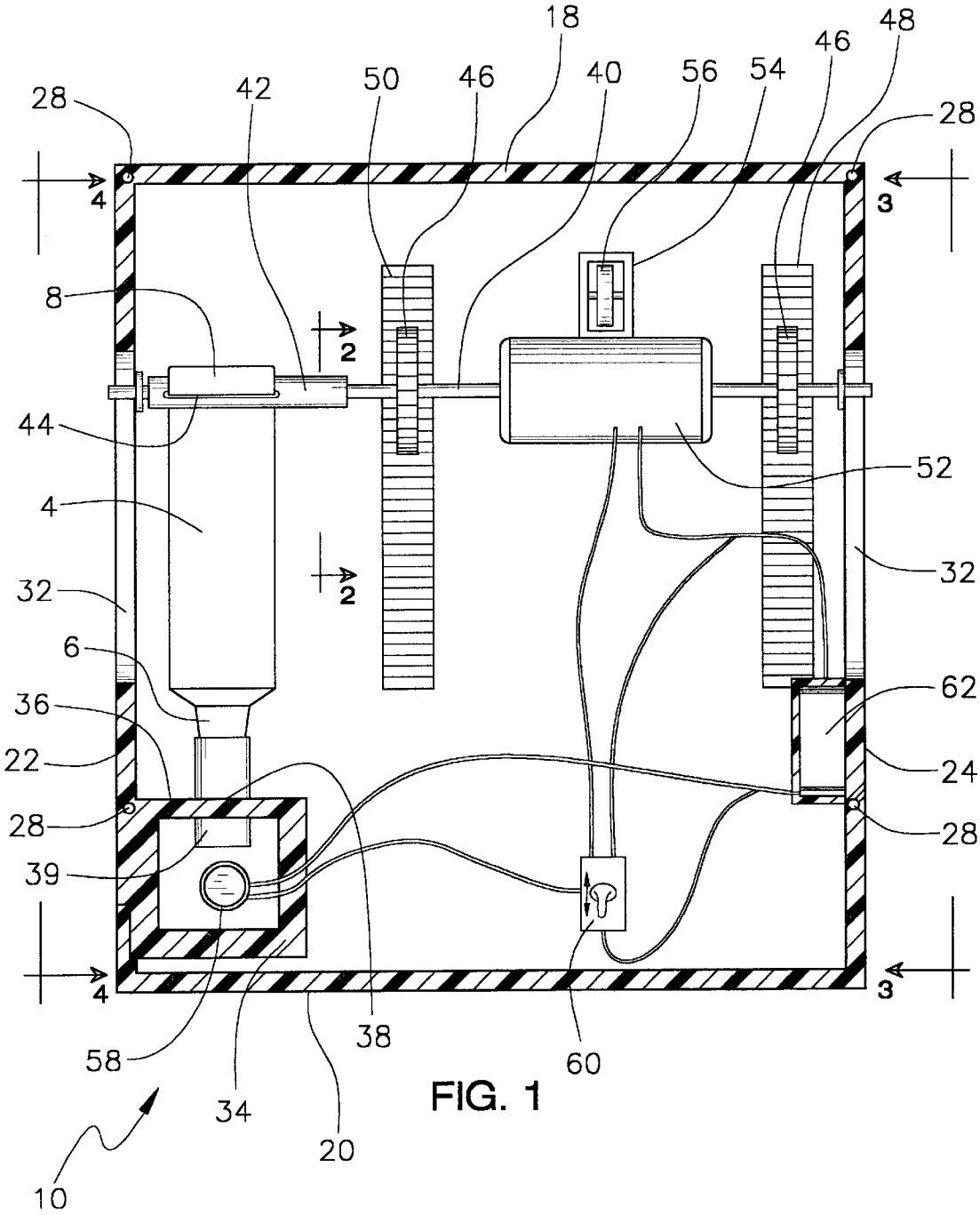
FIG. 1 is a schematic cross-sectional view of a new toothpaste extracting device according to the present invention.
Figure 2:
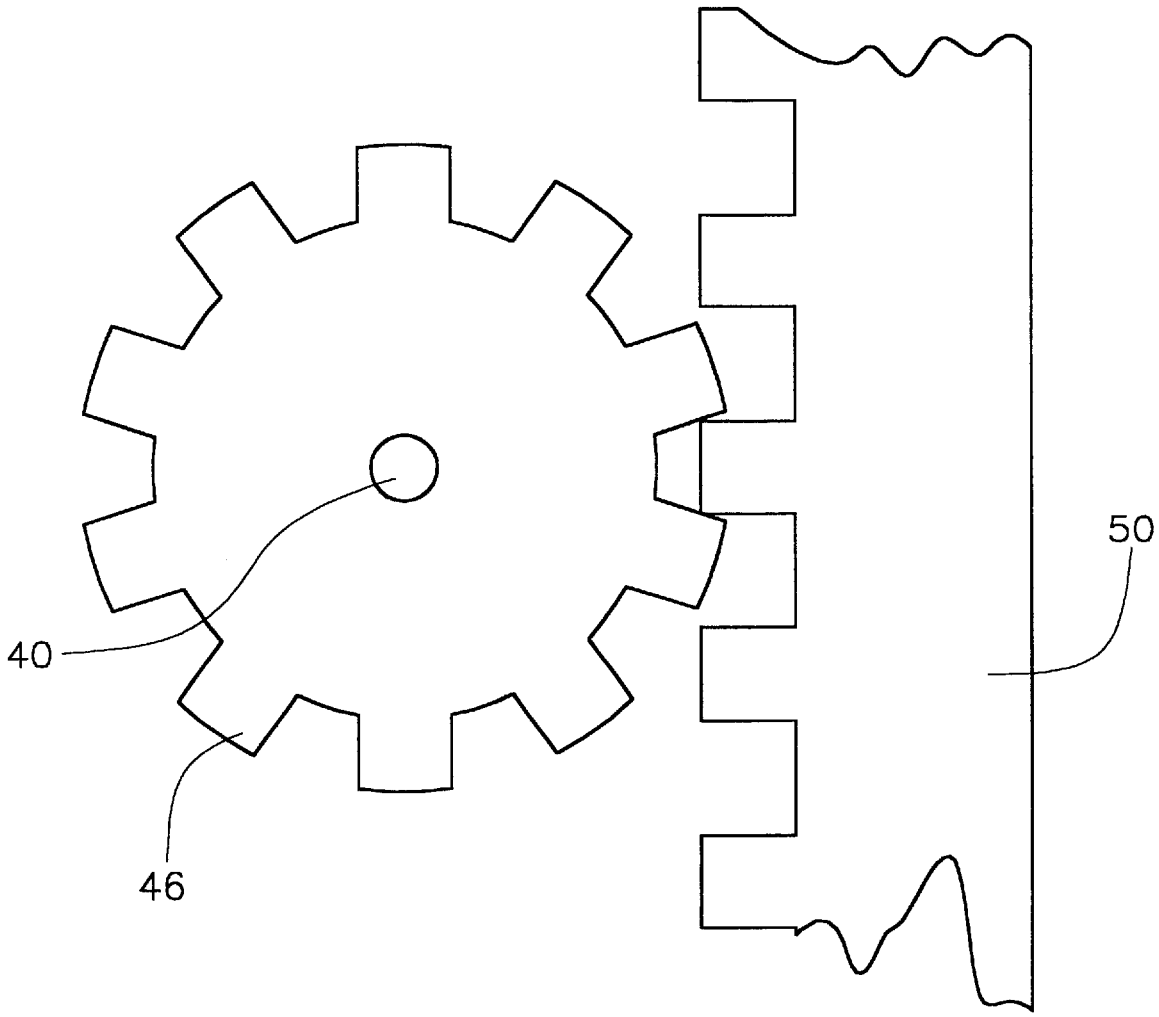
FIG. 2 is a schematic cross-sectional view taken along line 2—2 of FIG. 1 of the present invention.
Figure 3:
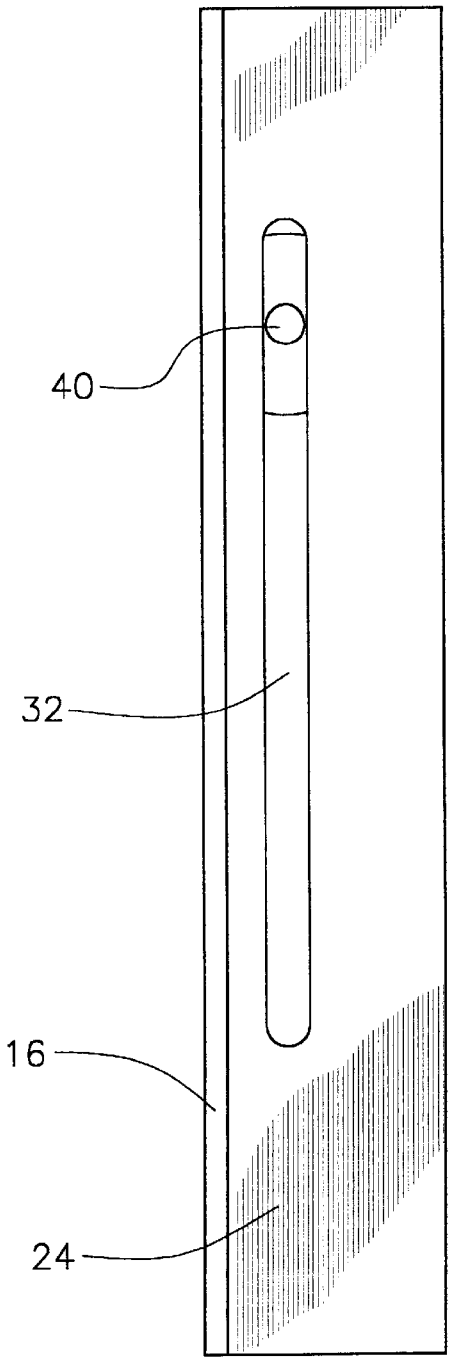
FIG. 3 is a schematic side view taken along line 3—3 of FIG. 1 of the present invention.
Figure 4:
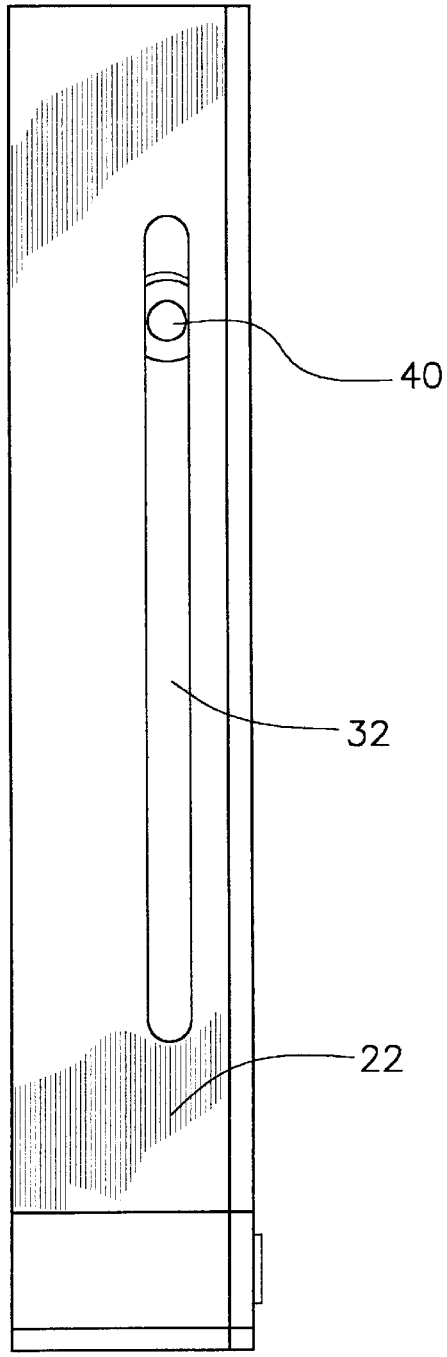
FIG. 4 is a schematic side view taken along line 4—4 of FIG. 1 of the present invention.
Figure 5:
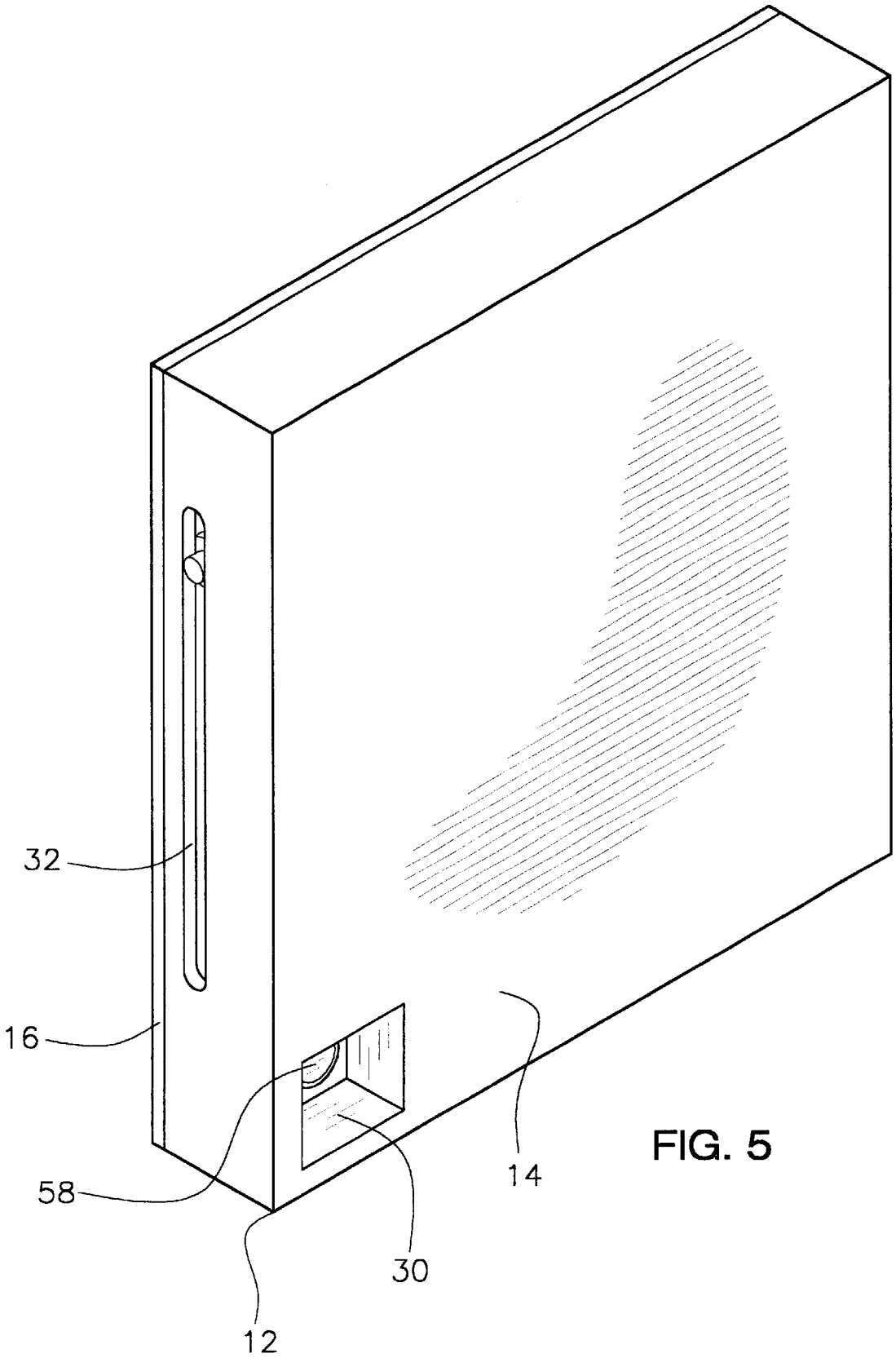
FIG. 5 is a schematic perspective view of the present invention.
Figure 6:
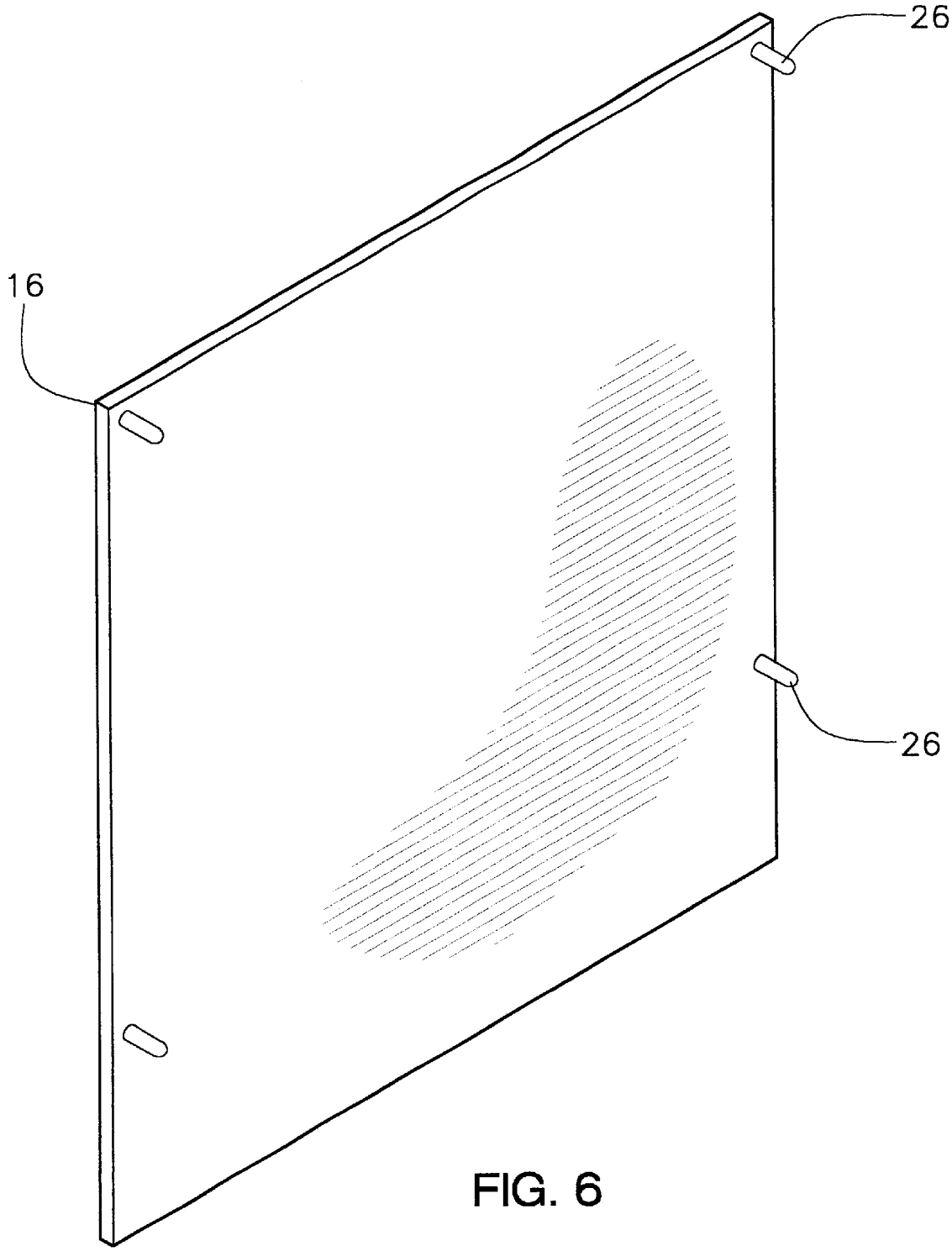
FIG. 6 is a schematic perspective view of the back wall of the present invention.

With reference now to the drawings, and in particular to FIGS. 1 through 6 thereof, a new toothpaste extracting device embodying the principles and concepts of the present invention and generally designated by the reference numeral 10 will be described.

As best illustrated in FIGS. 1 through 6, the toothpaste extracting device 10 generally comprises a housing 12 having a front wall 14, a back wall 16, a top wall 18, a bottom wall 20, a first side wall 22 and a second side wall 24. The back wall 16 is removably attached to the housing 12 and defines a door. The back wall 16 has a plurality of rods 26 thereon which are extendable into bores 28 in side walls 22, 24 for frictionally coupling the back wall 16 to the side walls 22, 24. The front wall 14 has an opening 30 therein positioned generally adjacent to a juncture of the bottom 20 wall and the first side wall 22. Each of first 22 and second 24 side walls has an elongated slot 32 therein. Each of the slots 32 is positioned generally between the top 18 and bottom 20 walls and each extends along a line extending between the top 18 and bottom 20 walls. The opening 30 is generally bounded by an inner housing 34 having an upper wall 36 having an aperture 38 extending therethrough for receiving an open end 6 of a tube of toothpaste 4. A sleeve 39 is preferably extended through the aperture 38 for receiving the toothpaste tube 4.

A spindle 40 is positioned in the housing 12 and extended through each of the slots 32. The spindle 40 has an engaging portion 42 positioned adjacent to the first side wall 22. The engaging portion 42 has a channel 44 extending therethrough for removably receiving a closed end 8 of the toothpaste tube 4. Each of a pair of gears 46 is positioned on the spindle 40.

A pair of tracks 48, 50 is positioned on an inner surface of the front wall 14. The tracks 48 are spaced from each other. A first of the tracks 50 is positioned generally adjacent to the second side wall 24 and a second of the tracks 50 is positioned between the first track 48 and the first side wall 22. Each of the gears 46 is positioned to engage one of the tracks 48, 50.

A motor 52 for rotating the spindle 40 is positioned between the gears 46 such that the spindle 40 extends through and is mechanically coupled to the motor 52. The motor 52 abuts the front wall 14. Preferably an arm 54 is extended from the motor 52 and contains a wheel 56 in abutment with the front wall 14 for stabilizing the motor 52 when the motor 52 rotates the spindle 40.

An actuator 58 for turning the motor 52 on such that the motor 52 rotates the spindle 40 in a first direction toward the bottom wall 20 is operationally coupled to the motor 52. The actuator 58 is positioned in the opening 30 and mounted on the inner housing 34.

A switch 60 for turning the motor 52 on such that the motor 52 rotates the spindle 40 in a second direction toward the top wall 18 is operationally coupled to the motor 52 and is mounted on the inner surface of the front wall 14. The switch 60 is positioned generally adjacent to the bottom wall 20.

A power supply 62 for powering the motor 52 is operationally coupled to the motor 52. The power supply 62 preferably comprises a battery removably mounted in the housing 12 and abutting the second side wall 24.

In use, a tube of toothpaste 4 is extended into the sleeve 39 and the closed end 8 extended through the engaging portion 42. A user places the head of their toothbrush into the opening 30 and against the actuator 58 so that the spindle 40 rotates and forces toothpaste out of the toothpaste tube 4. The user can see the spindle 40 extending through the slots 32 to indicate the amount of toothpaste remaining in the toothpaste tube. When the toothpaste tube 4 is empty the motor is reversed using the switch 60 to unravel the toothpaste tube 4 from the engaging portion 42 and replaced with a full toothpaste tube.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothpaste dispensing device for dispensing toothpaste from a tube of toothpaste, said device comprising:

a housing having a front wall, a back wall, a top wall, a bottom wall, a first side wall and a second side wall, said back wall being removably attached to said housing and defining a door, said front wall having an opening therein positioned generally adjacent to a juncture of said bottom wall and said first side wall, each of first and second side walls having an elongated slot therein, said opening being generally bounded by an inner housing having an upper wall having an aperture extending therethrough for receiving an open end of the tube of toothpaste;

a spindle being positioned in said housing and extending through each of said slots, said spindle having an engaging portion positioned adjacent to said first side wall adapted for removably receiving a closed end of the toothpaste tube, a pair of gears being positioned on said spindle;

a pair of tracks being positioned on an inner surface of said front wall, said tracks being spaced from each other, each of said gears being positioned to engage one of said tracks;

a motor for rotating said spindle being mechanically coupled to said spindle;

an actuator for turning said motor on such that said motor rotates said spindle in a first direction toward said bottom wall being operationally coupled to said motor.

2. The toothpaste dispensing device as in claim 1, wherein each of said slots are positioned generally between said top and bottom walls and each extending along a line extending between said top and bottom walls.

3. The toothpaste dispensing device as in claim 1, wherein said engaging portion has a channel extending therethrough for removably receiving the closed end of the toothpaste tube.

4. The toothpaste dispensing device as in claim 1, wherein a first of said tracks is positioned generally adjacent to said second side wall, a second of said tracks being positioned between said first track and said first side wall.

5. The toothpaste dispensing device as in claim 1, wherein said motor is positioned between said gears, said motor abutting said front wall.

6. The toothpaste dispensing device as in claim 1, wherein said actuator said actuator is positioned in said opening and mounted on said inner housing.

7. The toothpaste dispensing device as in claim 6, further including a switch for turning said motor on said such that said motor rotates said spindle in a second direction being operationally coupled to said motor and being mounted on said inner surface of said front wall and positioned generally adjacent to said bottom wall.

8. A toothpaste dispensing device for dispensing toothpaste from a tube of toothpaste, said device comprising:

a housing having a front wall, a back wall, a top wall, a bottom wall, a first side wall and a second side wall, said back wall being removably attached to said housing and defining a door, said front wall having an opening therein positioned generally adjacent to a juncture of said bottom wall and said first side wall, each of first and second side walls having an elongated slot therein, each of said slots being positioned generally between said top and bottom walls and each extending along a line extending between said top and bottom walls, said opening being generally bounded by an inner housing having an upper wall having an aperture extending therethrough for receiving an open end of the tube of toothpaste;

a spindle being positioned in said housing and extending through each of said slots, said spindle having an engaging portion positioned adjacent to said first side wall, said engaging portion having a channel extending therethrough for removably receiving a closed end of the toothpaste tube, a pair of gears being positioned on said spindle;

a pair of tracks being positioned on an inner surface of said front wall, said tracks being spaced from each other, a first of said tracks being positioned generally adjacent to said second side wall, a second of said tracks being positioned between said first track and said first side wall, each of said gears being positioned to engage one of said tracks;

a motor for rotating said spindle being positioned between said gears such that said spindle extends through and is mechanically coupled to said motor, said motor abutting said front wall;

an actuator for turning said motor on such that said motor rotates said spindle in a first direction toward said bottom wall being operationally coupled to said motor, said actuator being positioned in said opening and mounted on said inner housing;

a switch for turning said motor on said such that said motor rotates said spindle in a second direction being operationally coupled to said motor and being mounted on said inner surface of said front wall and positioned generally adjacent to said bottom wall; and a power supply for powering said motor being operationally coupled to said motor, said power supply comprising a battery removably mounted in said housing and abutting said second side wall.

* * * * *